US008035669B2

(12) United States Patent
Nakamura

(10) Patent No.: US 8,035,669 B2
(45) Date of Patent: Oct. 11, 2011

(54) IMAGE FORMING APPARATUS AND SHUTTER CONTROL METHOD

(75) Inventor: Takaji Nakamura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 358 days.

(21) Appl. No.: 12/207,461

(22) Filed: Sep. 9, 2008

(65) Prior Publication Data

US 2009/0067862 A1 Mar. 12, 2009

Related U.S. Application Data

(60) Provisional application No. 60/971,233, filed on Sep. 10, 2007, provisional application No. 60/971,249, filed on Sep. 10, 2007, provisional application No. 60/992,685, filed on Dec. 5, 2007, provisional application No. 60/992,686, filed on Dec. 5, 2007, provisional application No. 60/992,688, filed on Dec. 5, 2007, provisional application No. 61/028,439, filed on Feb. 13, 2008.

(51) Int. Cl.
*B41J 2/385* (2006.01)
*G03G 13/04* (2006.01)

(52) U.S. Cl. ..... 347/136; 347/129; 347/130; 347/131; 347/132; 347/133; 347/134; 347/135; 347/137; 347/138; 347/139

(58) Field of Classification Search ..... 347/111–170
See application file for complete search history.

(56) References Cited

U.S. PATENT DOCUMENTS

| | | | | |
|---|---|---|---|---|
| 5,752,133 | A * | 5/1998 | Nagase et al. | 399/112 |
| 5,805,192 | A * | 9/1998 | Sasaki et al. | 347/131 |
| 6,707,480 | B2 * | 3/2004 | Ameyama et al. | 347/129 |
| 7,187,399 | B2 * | 3/2007 | Noguchi et al. | 347/241 |
| 7,333,128 | B2 * | 2/2008 | Yoon | 347/241 |
| 7,352,377 | B2 * | 4/2008 | Matsutomo | 347/136 |
| 7,391,425 | B2 * | 6/2008 | Marsh et al. | 347/120 |
| 7,436,426 | B2 * | 10/2008 | Lim | 347/263 |
| 7,728,862 | B2 * | 6/2010 | Kishimoto | 347/236 |
| 7,778,562 | B2 * | 8/2010 | Kurose et al. | 399/51 |
| 2005/0243156 | A1 * | 11/2005 | Matsutomo | 347/136 |

FOREIGN PATENT DOCUMENTS

| | | |
|---|---|---|
| JP | 2000-263839 | 9/2000 |
| JP | 2005-192076 | 7/2005 |

* cited by examiner

*Primary Examiner* — Ryan Lepisto
*Assistant Examiner* — Guy Anderson
(74) *Attorney, Agent, or Firm* — Patterson & Sheridan, LLP

(57) ABSTRACT

According to an aspect of the invention, a control method for an exposure shutter of an image forming apparatus includes, opening the shutter only to a slit glass for monochrome when monochrome printing is performed, and opening the shutter to slit glasses for monochrome and color when color printing is performed.

19 Claims, 6 Drawing Sheets

IMAGE FORMING APPARATUS AND SHUTTER CONTROL METHOD

CROSS-REFERENCE TO RELATED APPLICATION

This application claims the benefit of U.S. Provisional Application No. 60/971,233, filed Sep. 10, 2007, No. 60/971,249, filed Sep. 10, 2007, No. 60/992,685, filed Dec. 5, 2007, No. 60/992,686, filed Dec. 5, 2007, No. 60/992,688, filed Dec. 5, 2007, and No. 61/028,439, filed Feb. 13, 2008.

TECHNICAL FIELD

The present invention relates to an image forming apparatus and a shutter control method, and, more particularly to an image forming apparatus that can form color and monochrome images.

BACKGROUND

As an image forming apparatus that forms color and monochrome images, there is known, for example, an image forming apparatus that includes laser units, photoconductive drums, and developing devices corresponding to respective color components of Y (yellow), M (magenta), C (cyan), and B (black), a transfer device, and a fixing device and can perform image formation in monochrome and image formation in color. Light sources, reflection mirrors, slit glasses, and the like corresponding to the respective colors are provided in the laser units.

In the image forming apparatus of this type, for example, as disclosed in JP-A-2005-192076 (laid open on Jul. 14, 2005), there is known an image forming apparatus in which shutters are provided on a photoconductive drum side of slit glasses to adjust a blocking state. In the image forming apparatus, the shutters in which plural blocking sections and plural transmitting sections corresponding to respective colors are formed are moved in a direction crossing beams to adjust a blocking state of the beams.

In general, the blocking state is adjusted according to switching of two states; an open state in which beams corresponding to all the colors are transmitted in association with the respective plural transmitting sections and a closed state in which the beams corresponding to all the colors are blocked in association with the respective plural transmitting sections.

However, in the image forming apparatus having the configuration described above, the slits corresponding to all the colors are in the open state even during monochrome printing. The slits corresponding to the colors other than black for which beams are not emitted during the monochrome printing are opened. Therefore, since unnecessary sections are opened, toners, dust, and the like tend to adhere to the sections. As a result, an image failure is caused.

Therefore, it is an object of the present invention to prevent adhesion of toners, dust, and the like and prevent an image failure.

SUMMARY

According to an aspect of the invention, a control method for an exposure shutter of an image forming apparatus, comprises, opening the shutter only to a slit glass for monochrome when monochrome printing is performed, and opening the shutter to slit glasses for monochrome and color when color printing is performed.

According to another aspect of the invention, a control method for an exposure shutter of an image forming apparatus, the control method comprises, moving only a first shutter that blocks light for monochrome when monochrome printing is performed, and moving the first shutter and a second shutter that blocks light for color separate from the first shutter when color printing is performed.

According to another aspect of the invention, an image forming apparatus comprises, a slit provided in an outlet of a laser beam source unit for a laser beam irradiated on a photoconductive member, a slit glass provided in the slit, a shutter provided to be opposed to the slit glass, and a cleaning member that is provided in the shutter and cleans the slit glass according to opening and closing of the shutter.

According to another aspect of the invention, an image forming apparatus comprises, a slit provided in an outlet of a laser beam source unit for a laser beam irradiated on a photoconductive member, a slit glass provided in the slit, and a shutter provided to be opposed to the slit glass, wherein the shutter is opened only to a slit glass for monochrome when monochrome printing is performed, and the shutter is opened to slit glasses for monochrome and color when color printing is performed.

According to another aspect of the invention, an image forming apparatus comprises, a beam irradiating unit that irradiates plural beams for color and black on photoconductive members, and a shutter in which plural blocking sections that block the plural beams, respectively, and plural transmitting sections that transmit the plural beams, respectively, are provided in parallel and that shift, in an opening and closing direction crossing an irradiating direction of the beams, among a first state in which the beams for black and color are opposed to the blocking sections, respectively, a second state in which the beam for color is opposed to the blocking section and the beam for black is opposed to the transmitting section, and a third state in which the beam for black and color are opposed to the transmitting sections and blocks or transmits the plural beams irradiated on the photoconductive members, respectively.

Objects and advantages of the invention will become apparent from the description which follows, or may be learned by practice of the invention.

DESCRIPTION OF THE DRAWINGS

The accompanying drawings illustrate embodiments of the invention, and together with the general description given above and the detailed description given below, serve to explain the principles of the invention.

DETAILED DESCRIPTION

First Embodiment

An image forming apparatus 1 according to a first embodiment of the present invention is explained below with reference to FIGS. 1 and 2. In the respective figures, a configuration is enlarged, reduced, or omitted to be schematically shown as appropriate. X, Y, and Z in the respective figures indicate three directions orthogonal to one another.

Figure 1:
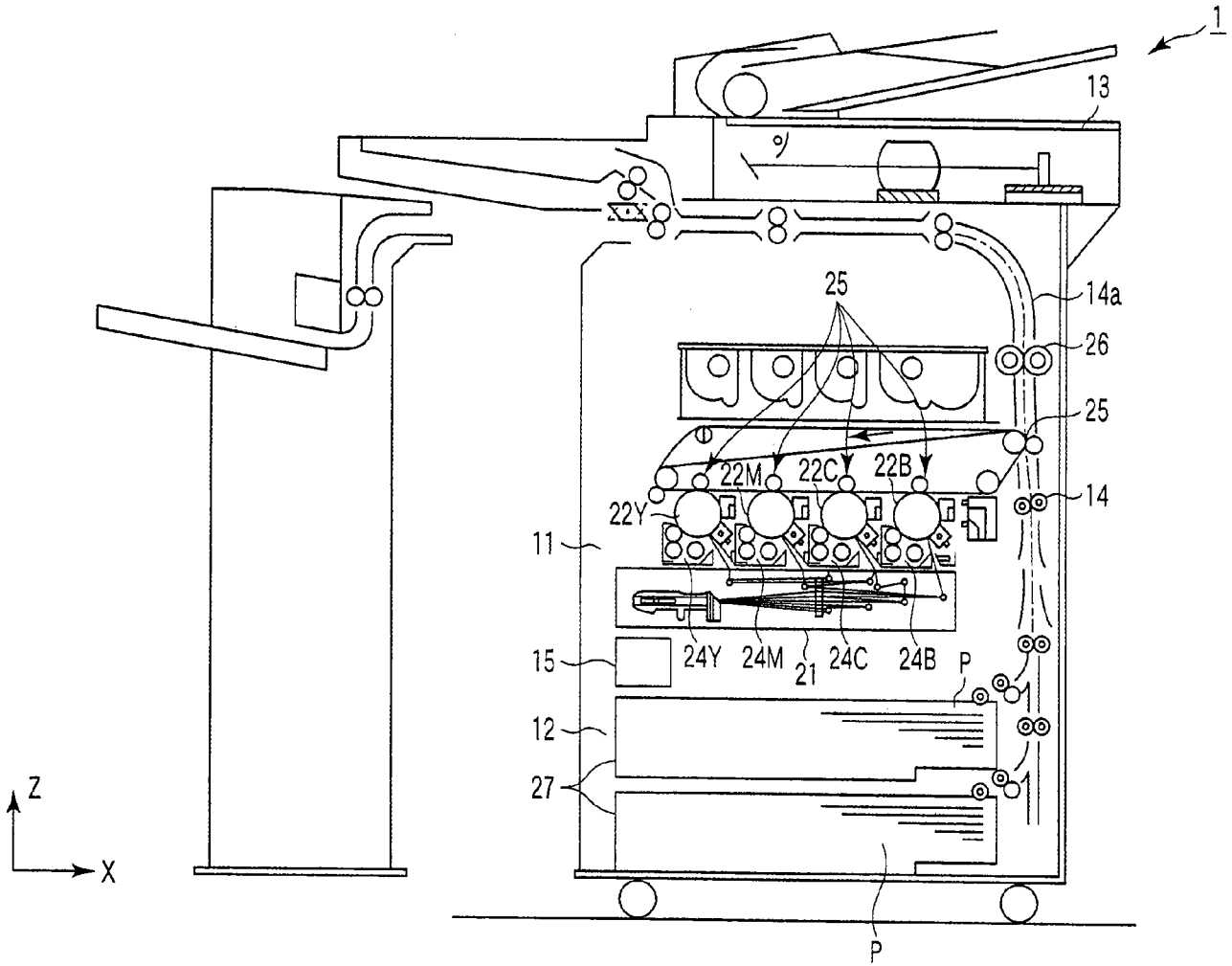
FIG. 1 is a schematic view for explaining a configuration of an image forming apparatus according to a first embodiment of the present invention.

The image forming apparatus 1 shown in FIG. 1 forms an monochrome image or a color image on a sheet P as a sheet-like medium using plural toners of, for example, Y (yellow), M (magenta), C (cyan), and B (black). Suffixes Y (yellow), M (magenta), C (cyan), and B (black) are attached to members of the image forming apparatus 1 corresponding to the respective colors to indicate a correspondence relation among the members.

The image forming apparatus 1 includes an image forming unit 11 for outputting image information such as characters, photographs, or graphics as an image output, a sheet feeding unit 12 that feeds the sheet P of an arbitrary size used for the image output to the image forming unit 11, an image scanning unit 13 (a scanner) that captures, as image data, image information, which is an object of image formation, from an object that keeps the image information, a conveying unit 14 including plural roller members that convey the sheet P along a predetermined conveying path 14*a*, and a control unit 15 that controls operations of the respective units.

The image forming unit 11 includes a laser beam unit 21 (a beam irradiating unit or a laser beam source unit) that irradiates laser beams 30 corresponding to the four colors, photoconductive drums 22 (Y, M, C, and B) corresponding to the four colors arranged above the laser unit 21, developing devices 24 (Y, M, C, and B) that supply toners to the photoconductive drums 22, a transfer device 25 that transfers toner images onto the sheet P (a transfer material), and a fixing device 26 that fixes the toner image on the sheet P.

The sheet feeding unit 12 arranged below the laser unit 21 includes plural sheet cassettes 27 that store recording medium, i.e., sheets P of plural kinds of sizes.

The photoconductive drums 22 are formed in a cylindrical drum shape and mounted to be rotatable by a driving motor (not shown). Beams are irradiated on the photoconductive drums 22 from the laser unit 21 to form electrostatic latent images corresponding to images to be formed.

Figure 2:
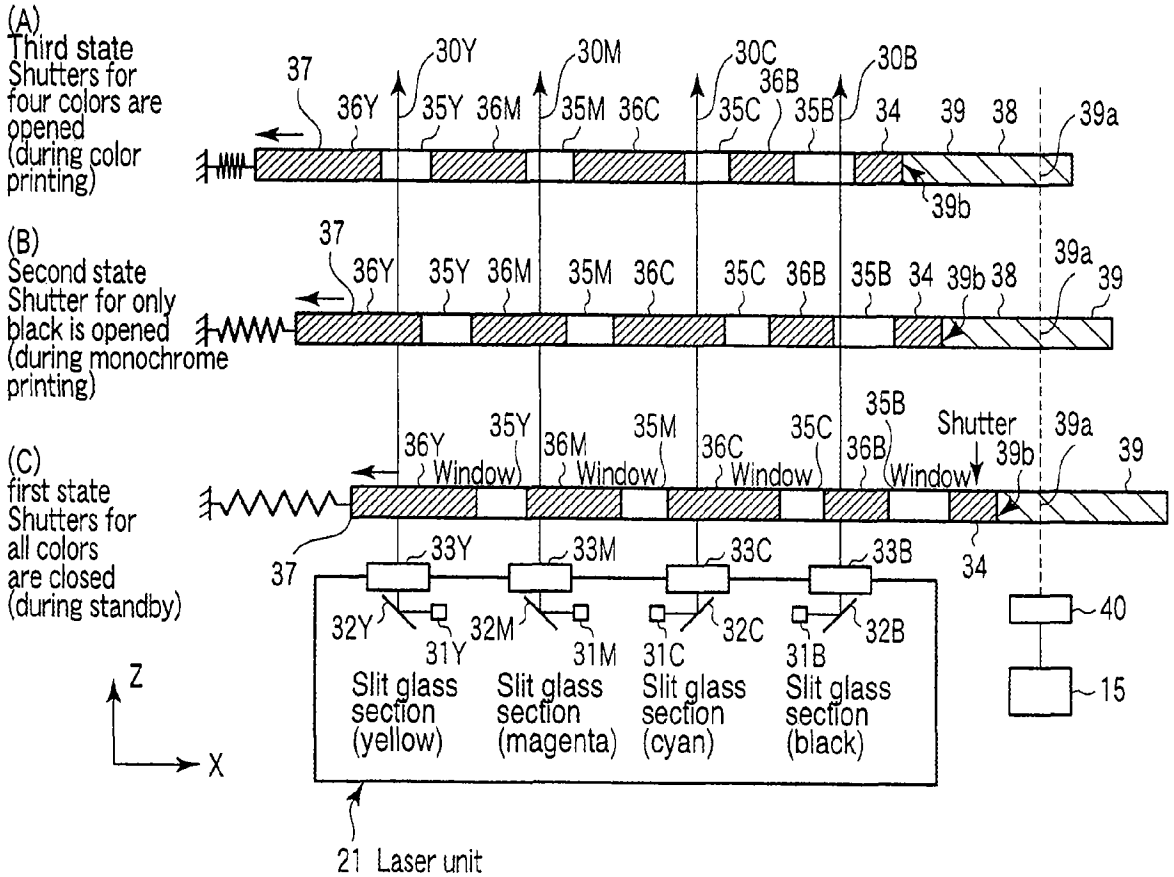
FIG. 2 is a diagram for explaining operations of the image forming apparatus according to the embodiment.

The laser unit 21 shown in FIG. 2 includes first to fourth light sources 31 (Y, M, C, and B) corresponding to the respective colors, first to fourth folding mirrors 32 (Y, M, C, and B) corresponding to the respective colors provided on a leading end side of beams of the light sources 31, and first to fourth slit glasses 33 (Y, M, C, and B) corresponding to the respective colors provided on the photoconductive drums 22 side of the folding mirrors 32. A shutter unit 34 is provided on a downstream side in an irradiating direction of the first to fourth slit glasses 33 (Y, M, C, and B), i.e., a photoconductive drums 22 side.

The first light source 31Y is, for example, a laser diode for yellow that emits the laser beam 30 corresponding to a yellow image. The second light source 31M is a laser diode for magenta that emits the laser beam 30 corresponding to a magenta image. The third light source 31C is a laser diode for cyan that emits the laser beam 30 corresponding to a cyan image. The fourth light source 31B is a laser diode for black that emits the laser beam 30 corresponding to a black image.

The first to fourth folding mirrors 32 deflect the laser beams 30 corresponding to the respective colors radiated from the light sources 31 and guide the laser beams 30 to the respective photoconductive drums 22 corresponding thereto.

The first to fourth slit glasses 33 are provided to be arranged in parallel in outlet positions of the laser unit 21 corresponding to the respective laser beams 30 (Y, M, C, and B). The slit glasses 33 are made of a transparent glass material or the like and formed in a slender rectangular shape. The slit glasses 33 have a function of transmitting the laser beams 30 and preventing dust.

The shutter unit 34 includes one shutter member 37 arranged between the four slit glasses 33 and the four photoconductive drums 22 and a moving mechanism 38 that moves the shutter member 37 in an X direction and adjusts a position of the shutter member 37.

The shutter member 37 shown in FIG. 2 is formed in a rectangular flat shape and is provided on a leading end side in a beam direction of the four slit glasses 33. In the shutter member 37, windows 35 as four transmitting sections corresponding to the slit glasses 33 of the respective colors are arranged in parallel along the X direction. Sections of the shutter member 37 other than the windows 35 configure blocking sections 36 that block light. All windows 35Y, 35M, and 35C for the colors of Y (yellow), M (magenta), and C (cyan) are formed in the same length. A window 35B for B (black) is formed longer than the windows 35Y, 35M, and 35C for the colors in the X direction.

The moving mechanism 38 moves the shutter member 37 and adjusts a blocking state of the laser beams 30. The moving mechanism 38 includes an eccentric cam 39 that rotates around a rotating shaft 39*a*. The eccentric cam 39 is rotated by a motor 40 controlled by a CPU of the control unit 15. A distance from the rotating shaft 39*a* to an outer surface of the eccentric cam 39 is different depending on a section. A part of the outer surface forms a transmission surface 39*b* that comes into contact with an end of the shutter member 37. A distance from the rotating shaft 39*a* to the contact surface changes according to a rotation phase. Therefore, according to the displacement of the transmission surface 39*b* corresponding to the rotation of the eccentric cam 39, the shutter member 37 moves in the left to right direction among first, second, and third states shown in FIG. 2. The shutter member 37 is urged to the eccentric cam 39 by a compression spring.

An opening and closing direction (a moving direction) of the shutter member 37 crosses an irradiating direction of the laser beams 30 irradiated on the shutter member 37. Whereas the laser beams 30 are irradiated upward as indicated by Z in the figure, the shutter member 37 can move in a direction indicated by X in the figure.

The shutter member 37 is arranged from one end side on the right in the figure to the other end side on the left in the figure on an X axis in the order of the first state (C), the second state (B), and the third state (A).

In the first state, the distance between the rotating shaft 39*a* and the transmission surface 39*b* of the eccentric cam 39 is the smallest and the shutter member 37 is located on the rightmost side. In the third state, the distance between the rotating shaft 39*a* and the transmission surface 39*b* of the eccentric cam 39 is the largest and the shutter member 37 is located on the leftmost side. In the second state, the distance between the rotating shaft 39*a* and the transmission surface 39*b* is larger than the distance in the first state and smaller than the distance in the third state. A position of the shutter in the second state is between the positions in the first state and the third state.

In the first state, as a positional relation, the four blocking sections 36 are respectively opposed to the slit glasses 33 of the respective colors. In the first state, all the slit glasses 33 corresponding to the respective colors are shielded.

In the second state, as a positional relation, the three blocking sections 36 are respectively opposed to the three-color slit glasses 33 (Y, M, and C) for color and the window 35 is opposed to the black slit glass 33B for monochrome. In the second state, only the laser beam 30 for black can pass through the slit glass. The slit glasses 33 for color are shielded. Therefore, only a monochrome image can be formed.

In the third state, as a positional relation, the four windows 35 are respectively opposed to the slit glasses 33 (Y, M, C, and B) for the respective colors and the laser beams 30. In the third state, all the laser beams 30 for the respective colors can pass through the slit glasses.

The eccentric cam 39 is rotated according to the control by the control unit 15 to adjust a position of the shutter member 37 such that the shutter member 37 is in the third state in a color mode for forming images of both color and monochrome, in the second state in a monochrome mode for forming an image of only monochrome, and in the first state in a stop mode for not forming images of both color and monochrome.

In the image forming apparatus 1 configured as described above, the laser beams 30Y, 30M, 30C, and 30B radiated from the light source 31 are deflected by the folding mirrors 32, respectively, passes through the transmitting sections of the shutter member 37, and are irradiated on the respective photoconductive drums 22. The laser unit 21 outputs image lights corresponding to the respective photoconductive drums 22, exposes the photoconductive drums 22, and forms electrostatic latent image thereon.

The electrostatic latent images formed on the photoconductive drums 22 are developed with toners stored by the developing devices 24 and visualized. Toner images, i.e., output images on the photoconductive drums 22 transferred, by the transfer device 25, onto only one sheet-like medium, i.e., sheet P drawn out from any one of the cassettes by a paper feeding roller and a separation roller and conveyed through a conveying path toward the transfer device 25.

The toner images (the output images) transferred onto the sheet P are fixed on the sheet P by the fixing device 26. The sheet P having the toner images fixed thereon is discharged from a predetermined discharge port.

On the other hand, in the image forming apparatus 1, when a user instructs to scan image information from a sheet-like medium, i.e., an original using the image scanning unit 5 (the ADF 7) and form an image, i.e., copy an image, the image information of the original is captured by the image scanning unit 5 as shading of light. Thereafter, in the same process as the printout already explained, toner images corresponding to the image information of the original is formed and transferred onto the sheet P conveyed through the conveying path at predetermined timing.

With the image forming apparatus according to this embodiment, effects described below are obtained.

The pitch and the width of the windows 35 of the shutter member 37 are set as described above to control only a moving distance with an integral shutter. This makes it possible to open the shutter only for black during monochrome printing. Therefore, it is possible to provide the shutter unit 34 and the image forming apparatus 1 that are inexpensive and in which the slit glasses 33 are less easily soiled.

Second Embodiment

An image forming apparatus according to a second embodiment of the present invention is explained with reference to FIG. 3. Components other than the shutter unit 34 are configured the same as those in the first embodiment. Therefore, the components are denoted by the same reference numerals and signs and explanation of the components is omitted.

Figure 3:
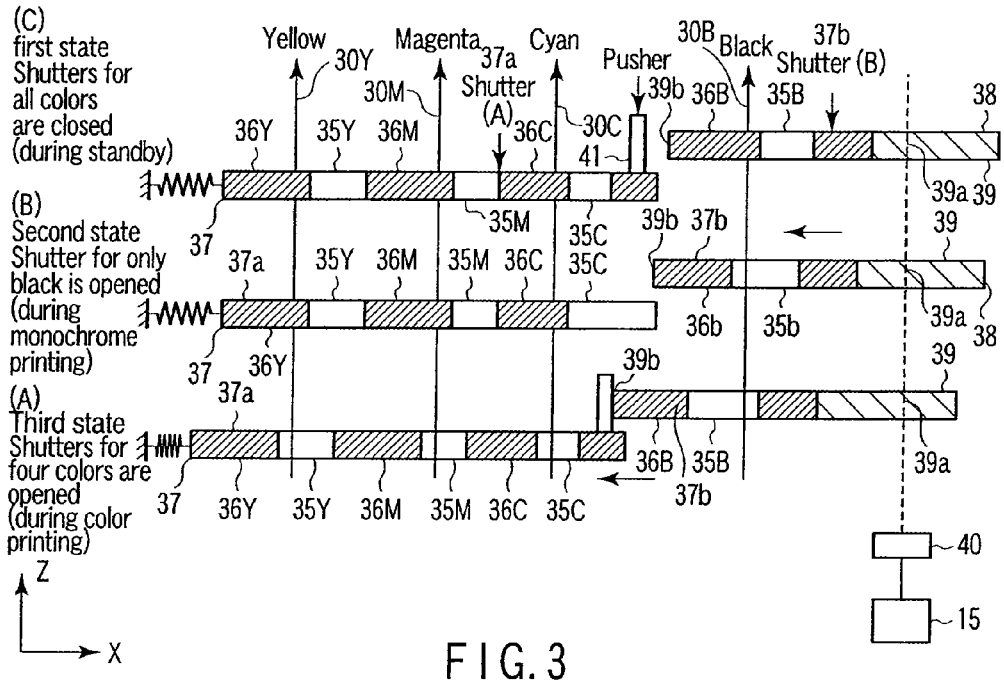
FIG. 3 is a diagram for explaining operations of an image forming apparatus according to a second embodiment of the present invention.

In the image forming unit 11 according to this embodiment, as shown in FIG. 3, a first shutter (a shutter member) 37*a* that blocks light for exposing photoconductive drums for color and a second shutter 37*b* that blocks light for exposing a photoconductive drum for black are separately configured. In the first embodiment, the windows 35 corresponding to the four colors and the shutter member 37 having the blocking sections are integrally configured. However, in this embodiment, only the shutter member for black is separately configured.

The moving mechanism 38 is provided at an end of the second shutter member 37*b*. When the eccentric cam 39 of the moving mechanism 38 rotates according to the control by the control unit 15, the second shutter member 37*b* is pressed.

The second shutter member 37*b* is arranged above the first shutter member 37*a*. A pusher 41 (a transmitting unit) for power transmission is provided at an end on the second shutter member 37*b* side of the first shutter member 37*a*.

The pusher 41 is formed by a tabular member that extends upward from the blocking section 36 at an end of the first shutter member 37*a*. When the second shutter member 37*b* is moved to the first shutter member 37*a* side, i.e., to the left by the moving mechanism 38, the second shutter member 37*b* presses the pusher 41 to the left.

The moving mechanism 38 moves the second shutter member 37*b* to adjust a blocking state of the laser beam 30. The moving mechanism 38 includes the eccentric cam 39 that pivots around the rotating shaft 39*a*. A distance from the rotating shaft 39*a* to the outer surface of the eccentric cam 39 is different depending on a section. A part of the outer surface forms a contact surface that comes into contact with an end of the shutter member 37*b*. A distance from the rotating shaft 39*a* to the contact surface changes according to a rotation phase. Therefore, according to the displacement of the contact surface corresponding to the rotation of the eccentric cam 39, the shutter member 37 moves in the left to right direction among first, second, and third states shown in FIG. 3. The shutter member 37 is arranged from one end side on the right in the figure to the other end side on the left in the figure in the order of the first state, the second state, and the third state.

In the first state, the distance between the rotating shaft 39*a* and the transmission surface 39*b* of the eccentric cam 39 is the smallest and the shutter member 37 is located on the rightmost side. In the third state, the distance between the rotating shaft 39*a* and the transmission surface 39*b* of the eccentric cam 39 is the largest and the shutter member 37 is located on the leftmost side. In the second state, the distance between the rotating shaft 39*a* and the transmission surface 39*b* is larger than the distance in the first state and smaller than the distance in the third state. A position of the shutter in the second state is between the positions in the first state and the third state.

In the first state, as a positional relation, the four blocking sections 36 are respectively opposed to the slit glasses 33 of the respective colors. In the first state, all the slit glasses 33 corresponding to the respective colors are shielded.

In the second state, as a positional relation, the three blocking sections 36 are respectively opposed to the three-color slit glasses 33 (Y, M, and C) for color and the window 35 is opposed to the black slit glass 33B for monochrome. In the second state, only the laser beam 30 for black can pass through the slit glass. The slit glasses 33 for color are shielded. Therefore, only a monochrome image can be formed.

In the third state, as a positional relation, the four windows 35 are respectively opposed to the slit glasses 33 for the respective colors and the laser beams 30. In the third state, all the laser beams 30 for the respective colors can pass through the slit glasses.

The eccentric cam 39 is rotated according to the control by the control unit 15 to adjust a position of the shutter member 37 such that the shutter member 37 is in the third state in a color mode for forming images of both color and monochrome, in the second state in a monochrome mode for forming an image of only monochrome, and in the first state in a stop mode for not forming images of both color and monochrome.

In other words, when the shutter member 37 shifts from the first state to the second state, the second shutter member 37*b* is separated from the pusher 41. The first shutter member 37*a* does not move and only the second shutter member 37*b* moves. When the shutter member 37 shifts from the second state to the third state, the pusher 41 is pressed by the movement of the second shutter member 37*b* and moves the first shutter member 37*a*.

In this embodiment, effects same as those in the first embodiment are obtained. Moreover, since the first shutter member 37*a* for color moves only in the color mode, only small driving power is necessary. Even in this case, since one driving power source is sufficient, a configuration of the image forming apparatus can be simplified.

Third Embodiment

Figure 4:
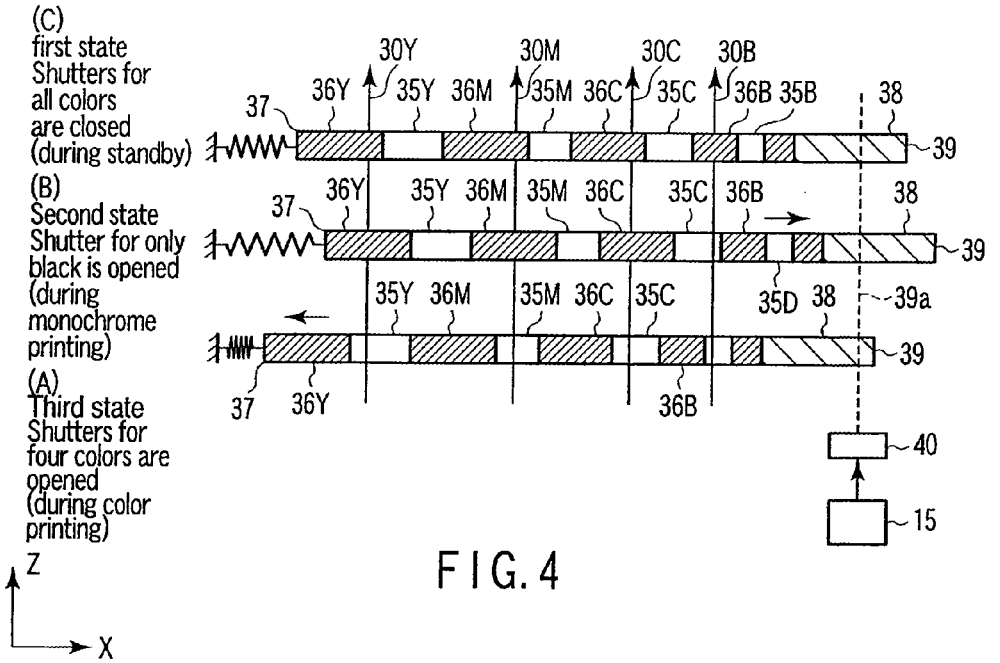
FIG. 4 is a diagram for explaining operations of an image forming apparatus according to a third embodiment of the present invention.

An image forming apparatus according to a third embodiment of the present invention is explained with reference to FIG. 4. Components other than the shutter unit 34 are configured the same as those in the first embodiment. Therefore, the components are denoted by the same reference numerals and signs and explanation of the components is omitted.

In the image forming unit 11 according to this embodiment, windows 35B for black in the shutter member 37 are respectively arranged on both sides, i.e., one end side on the left and the other end side on the right, across a blocking section 36B for black. The windows 35 for color are provided for the corresponding colors, respectively.

Shutters are switched by moving in opposite directions when only the shutter for black is opened and when all the shutters for the four colors are opened.

The moving mechanism 38 moves the shutters to adjust a blocking state of the laser beams 30. The moving mechanism 38 includes the eccentric cam 39 that pivots around the rotating shaft 39*a*. A distance from the rotating shaft 39*a* to the outer surface of the eccentric cam 39 is different depending on a section. A part of the outer surface forms a contact surface that comes into contact with an end of the shutter member 37. A distance from the rotating shaft 39*a* to the contact surface changes according to a rotation phase. Therefore, according to the displacement of the contact surface corresponding to the rotation of the eccentric cam 39, the shutter member 37 moves in the left to right direction among first, second, and third states shown in FIG. 4. The shutter member 37 is arranged from one end side on the right in the figure to the other end side on the left in the figure in the order of the second state, the first state, and the third state. That is, in the second state, the shutter member 37 is located on the rightmost side.

In the second state, the distance between the rotating shaft 39*a* and the transmission surface 39*b* of the eccentric cam 39 is the smallest and the shutter member 37 is located on the rightmost side. In the third state, the distance between the rotating shaft 39*a* and the transmission surface 39*b* of the eccentric cam 39 is the largest and the shutter member 37 is located on the leftmost side. In the first state, the distance between the rotating shaft 39*a* and the transmission surface 39*b* is larger than the distance in the second state and smaller than the distance in the third state. A position of the shutter in the first state is between the positions in the second state and the third state.

In the first state, as a positional relation, the four blocking sections 36 are respectively opposed to the slit glasses 33 of the respective colors. In the first state, all the slit glasses 33 corresponding to the respective colors are shielded.

In the second state, as a positional relation, the three blocking sections 36 are respectively opposed to the three-color slit glasses 33 for color and the window 35 is opposed to the black slit glass 33B for monochrome. In the second state, only the laser beam 30 for black can pass through the slit glass. The slit glasses 33 for color are shielded. Therefore, only a monochrome image can be formed. In the second state, the laser beam 30B for black is transmitted through the window 35B formed on the left side of the blocking section 36B.

In the third state, as a positional relation, the four windows 35 are respectively opposed to the slit glasses 33 for the respective colors and the laser beams 30. In the third state, all the laser beams 30 for the respective colors can pass through the slit glasses. In the third state, the laser beam 30B for black is transmitted through the window 35B formed on the right side of the blocking section 36B.

The shutter member 37 moves in opposite directions when the shutter member 37 shifts from the first state to the second state and when the shutter member 37 shifts from the first state to the third state.

The eccentric cam 39 is rotated according to the control by the control unit 15 to adjust a position of the shutter member 37 such that the shutter member 37 is in the third state in a color mode for forming images of both color and monochrome, in the second state in a monochrome mode for forming an image of only monochrome, and in the first state in a stop mode for not forming images of both color and monochrome.

In this embodiment, effects same as those in the first embodiment are obtained. Moreover, since the two windows 35 for black are formed and the shutters moves in both the left and right directions when only the shutter for black is opened and when all the shutters for the four colors are opened, only a short overall stroke is necessary. Therefore, the shutters can be reduced in size.

Fourth Embodiment

Figure 5:
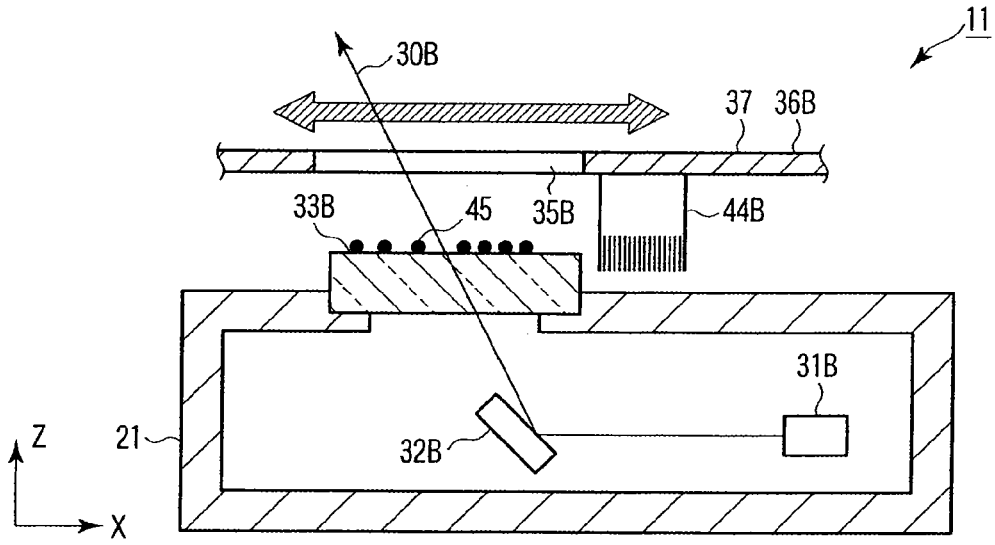
FIG. 5 is a schematic view for explaining a part of an image forming apparatus according to a fourth embodiment of the present invention.

An image forming apparatus according to a fourth embodiment of the present invention is explained with reference to FIG. 5. Components other than cleaning members 44 are configured the same as those in the first embodiment. Therefore, the components are denoted by the same reference numerals and signs and explanation of the components is omitted. In FIG. 5, only a section corresponding to a laser beam for black is shown as an example.

In the image forming unit 11 according to this embodiment, as shown in FIG. 5, the cleaning member 44 is provided on a rear surface of the shutter member 37, i.e., a surface on the slit glass 33 side. In other words, a member for cleaning the slit glass 33 of the laser unit 21 is attached to a shutter bracket (a shutter member) 37 to automatically clean the slit glass 33 simultaneously with opening and closing operations of the shutters.

The shutter bracket (the shutter member) 37 is set close to the slit glass 33 of the laser unit 21. The cleaning member 44 is attached near each of the windows 35. The cleaning member 44 is formed by an elastic blade, a non-woven fabric, a brush of nylon or wool, a foam such as sponge, and the like.

The shutter bracket (the shutter member) 37 attached with the cleaning member 44 moves back and forth on the slit glass 33 soiled by a deposit of dust and a toner, whereby the cleaning member 44 moves back and forth in contact with the slit glass 33 to automatically clean the soil of the slit glass 33. Since the slit glass 33 is cleaned every time the shutter is opened and closed, it is possible to clean the slit glass 33 before the deposit of dust and a scattered toner worsens.

In this embodiment, it is possible to prevent soil due to the deposit of dust, a scattered toner, and the like on the slit glass 33, which is set for dust proof in the slit (window) provided in the outlets of the unit of the laser beam source 31 for laser beams irradiated on the photoconductive members (the photoconductive drums 22), or prevent an image failure by cleaning the soil. In the normal image forming apparatus, the shutter member and the cleaning mechanism for preventing soil of the slit glasses of the laser unit are separately provided. However, in this embodiment, since the shutter member and the cleaning mechanism are integrated, it is possible to improve cleaning performance and simply operations. Therefore, it is possible to eliminate unevenness of cleaning and prevent the image forming apparatus from being shut down because the front cover is opened every time cleaning is performed.

In the past, since a user performs cleaning manually, the user does not notice image soil only after the image soil appears. Therefore, unevenness in cleaning occurs. Moreover, since the front cover is opened every time cleaning is performed, the image forming apparatus is shut down every time cleaning is performed. According to this embodiment, these inconveniences can be solved.

Fifth Embodiment

Figure 6:
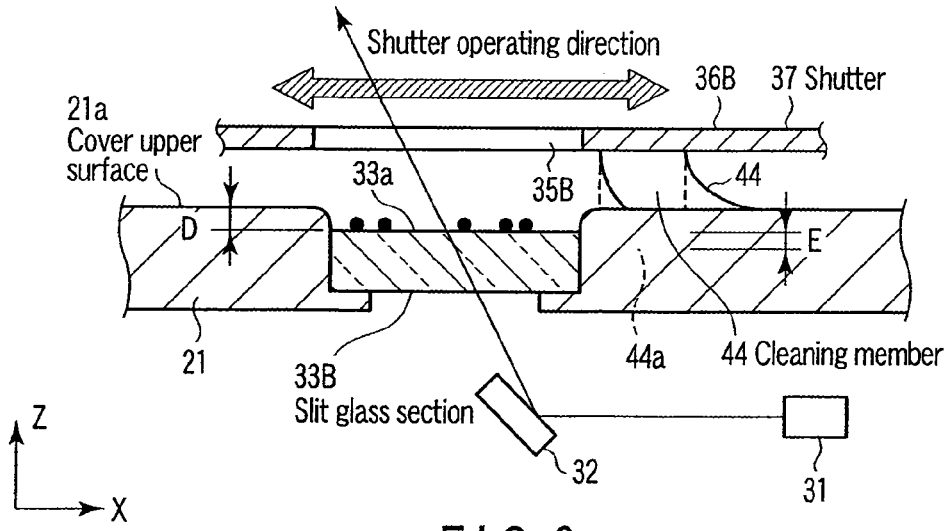
FIG. 6 is a schematic view for explaining a part of an image forming apparatus according to a fifth embodiment of the present invention.

An image forming apparatus 1 according to a fifth embodiment of the present invention is explained with reference to FIG. 6. Explanation of components and operations same as those in the first to fourth embodiments is omitted. In FIG. 6, a Z axis indicates an up to down direction and an X axis indicates an opening and closing direction of a shutter member. In FIG. 6, as an example, only a section corresponding to a laser beam for black is shown.

For example, components described below are used in order to improve cleaning performance of the cleaning member 44 and durable life of cleaning (the cleaning member 44) and prevent deficiencies in that the cleaning member 44 is scraped by an edge of the slit glass 33 and chips of the cleaning member 44 and deposits adhere to the surface of the slit glass 33.

Processing for improving lubricity, for example, processing such as water repellent coating, slipperiness improvement coating, application of a lubricant, or application of a surface active agent is applied to a surface (an upper surface) 33*a* of the slit glass 33.

The cleaning member 44 is formed by a flexible member that bends on a distal end side when the member is pressed against the slit glass 33. The cleaning member 44 is formed by, for example, a conductive acryl brush, a lubricant applied brush, a non-woven fabric, or a nylon brush.

A step D in the up to down direction is formed between an upper surface 21*a* of the laser unit 21 and the upper surface 33*a* of the slit glass 33 arranged in the laser unit 21. In other words, the upper surface 33*a* of the slit glass 33 is located slightly below the upper surface 21*a* of the laser unit 21. The step D is set to, for example, 0.2 mm or more.

The length of the cleaning member 44 is set to, for example, free length of 3.5±0.5 mm. An amount of cutting E into the slit glass 33 is set to 1.5±0.5 mm. A distal end section 44*a* of the cleaning member 44 is pressed by the slit glass 33 to bend and is in contact with the upper surface 33*a* of the slit glass 33 as indicated by a solid line in the figure. However, a dimension of the distal end section 44*a* of the cleaning member 44 is set such that the distal end section 44*a* is located 1.5±0.5 mm below the upper surface of the slit glass 33 in a free state indicated by a broken line in the figure.

With the image forming apparatus according to this embodiment, effects described below are obtained.

Since a positional relation between the member and the glass edge, an amount of cutting into the glass surface, and lubricity of the glass surface are optimized, it is possible to improve cleaning performance of the cleaning member 44 and the durable life of cleaning (the cleaning member 44). Further, it is possible to prevent deficiencies in that the cleaning member 44 is scraped by the edge of the slit glass 33 and chips of the cleaning member 44 and deposits adhere to the surface of the slit glass 33.

Moreover, when an inclined section is provided in an area of the laser unit 21 from the upper surface 21*a* of the laser unit 21 to the upper surface 33*a* of the slit glass 33, this contributes to relaxation of friction of the cleaning member 44 and removal of residual deposits on the glass upper surface.

Sixth Embodiment

Figure 7:
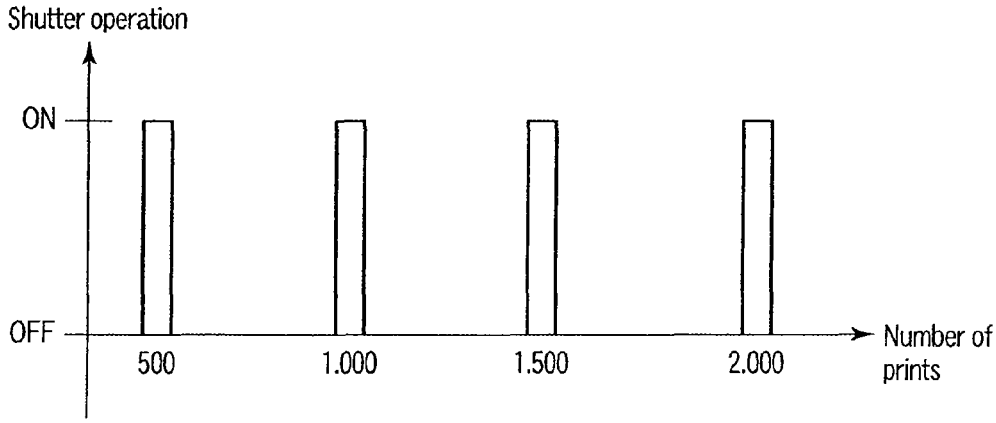
FIG. 7 is a graph showing a relation between operations of a shutter mechanism and the number of prints of an image forming apparatus according to a sixth embodiment of the present invention.
Figure 8:
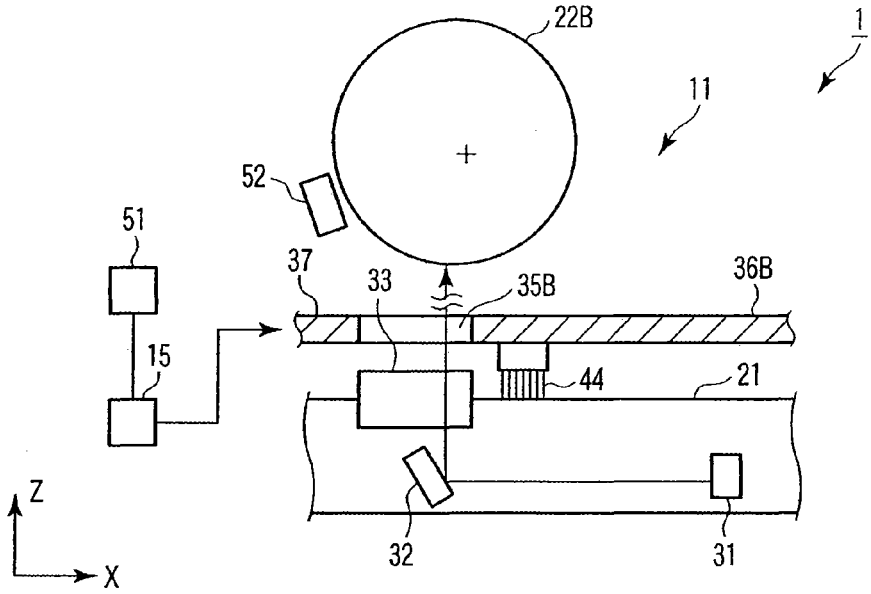
FIG. 8 is a diagram for explaining a configuration of a part of an image forming apparatus according to seventh and eighth embodiments of the present invention.

A sixth embodiment of the present invention is explained with reference to FIGS. 7 and 8. The sixth embodiment is the same as the fourth embodiment except that shutter opening and closing operations are performed according to the number of prints. Therefore, the same components are denoted by the same reference numerals and signs and explanation of the components is omitted. In FIG. 8, as an example, only a section corresponding to a laser beam for black is shown as an example.

The image forming apparatus 1 according to this embodiment includes a print counter 51. The control unit 15 performs control, on the basis of information from the print counter 51, to automatically move the shutter member 37 when the number of prints exceeds a fixed value. In other words, the control unit 15 performs opening and closing operations of the shutter (member) 37 according to the number of prints and cleans the slit glass 33 using the cleaning member 44 attached to the shutter bracket 37. For example, the control unit 15 performs shutter opening and closing operations every time the print counter 51 counts 500 prints. With the configuration described above, it is possible to automatically perform most efficient cleaning of the slit glass 33.

In this embodiment, effects same as those in the fourth embodiment are obtained. In the case of a large number of prints, the slit glass 33 can be cleaned at appropriate timing by performing the opening and closing operations in the middle of the printing. This embodiment can be easily applied to the normal image forming apparatus 1 including a print counter.

Seventh Embodiment

A seventh embodiment of the present invention is explained with reference to FIG. 8. The seventh embodiment is the same as the sixth embodiment except that shutter opening and closing operations are performed according to potentials on photoconductive drums. Therefore, explanation of the same components is omitted.

In the image forming apparatus 1 according to this embodiment, a surface potential sensor 52 is arranged near the outer periphery of the photoconductive drum 22. The surface potential sensor 52 detects a potential on the surface of the photoconductive drum 22.

The control unit 15 controls shutter opening and closing operations on the basis of the potential detected by the surface potential sensor 52.

For example, the control unit 15 monitors potentials on the drums and, when the slit glass 33 soils and the potential changes, performs shutter opening and closing operations and cleans the slit glass 33. When the slit glass 33 soils, an amount of beams passing through the slit glass 33 decreases and a potential in an exposed portion on the surface of the photoconductive drum 22 deviates from a fixed value. Therefore, the control unit 15 determines that the slit glass 33 is dirty and opens and closes the shutter member 37. When the shutter member 37 opens and closes, the control unit 15 cleans the slit glass 33 using the cleaning member 44 provided near the window 35. In this embodiment, effects same as those in the sixth embodiment are obtained.

Eighth Embodiment

Figure 9:
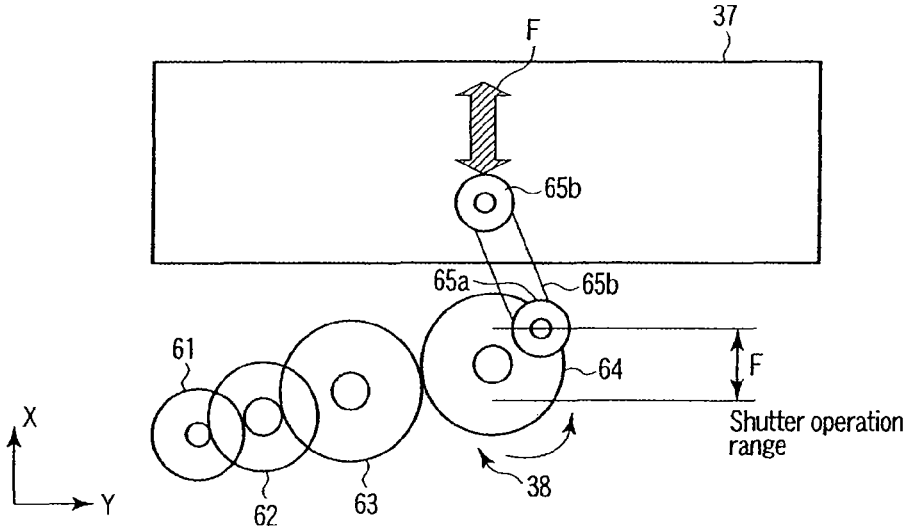
FIG. 9 is a plan view showing a configuration of a moving mechanism of the image forming apparatus according to the eighth embodiment.

An image forming apparatus 1 according to an eighth embodiment of the present invention is explained with reference to FIG. 9. The eighth embodiment is the same as the first embodiment except that a reciprocating slider crank mechanism is used for driving a shutter. Therefore, explanation of the same components is omitted.

In the image forming apparatus 1 according to this embodiment, a slider crank mechanism is provided as the moving mechanism 38 instead of the eccentric cam 39 in the first embodiment.

The slider crank mechanism includes a motor 61 controlled by the control unit 15, two reduction gears 62 and 63 that receive a rotary motion of the motor 61 and reduce rotating speed, a crank 64 that rotates in response to a rotary motion of the reduction gear 63, and a link 65 pivotally attached to the crank 64 at one end 65*a* and connected to the shutter member 37 at the other end 65*b*.

A rotary motion of the crank 64 is converted into a linear motion of the other end 65*b* of the link 65.

The motor 61 is driven and the gears 62 and 63 are decelerated to rotate the crank 64 in one direction, whereby a fulcrum on the other end side of the link 65 moves in an X direction indicated by an arrow. Since a shutter bracket is attached to the fulcrum of the link 65, the shutter member 37 moves in an X direction, i.e., an opening and closing direction.

According to this embodiment, since the crank mechanism is used, it is possible to secure an operation range F without increasing a size of the position adjusting mechanism 38 in the X direction.

Therefore, it is possible to smoothly perform a reciprocating motion for repeating acceleration and deceleration and provide a shutter mechanism with a smaller number of components. Compared with the eccentric cam 39 system, a space for a driving unit is saved. In other words, in the system using the eccentric cam 39, since a distance of shutter driving operation is equal to (a maximum radius from the rotation center)−(a minimum radius from the rotation center), there is a drawback (a problem) in that a unit is large. However, according to this embodiment, it is possible to secure a moving distance without increasing a size of the unit.

Ninth Embodiment

Figure 10:
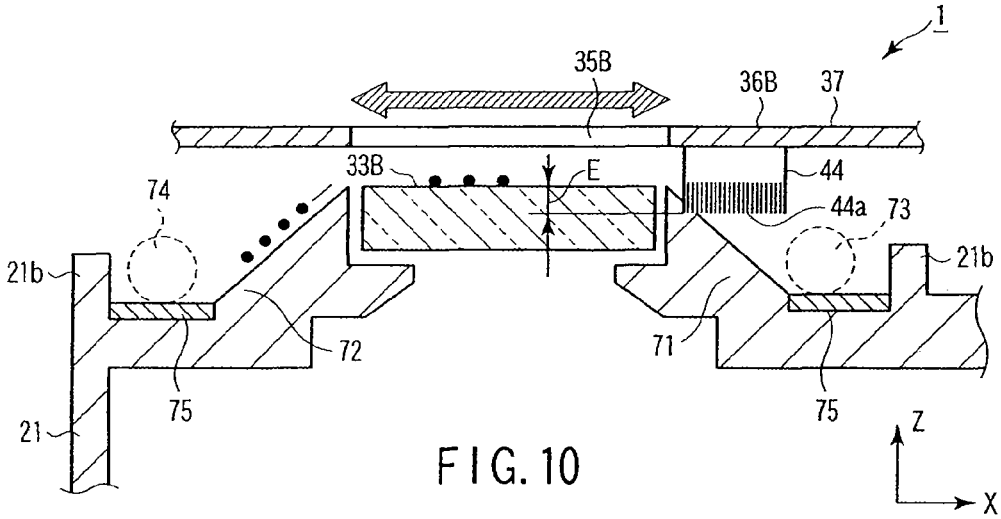
FIG. 10 is a schematic view for explaining configuration of an image forming apparatus according to a ninth embodiment of the present invention.

A ninth embodiment of the prevent invention is explained with reference to FIG. 10. The ninth embodiment is the same as the first to eighth embodiments except that slopes and adhesive layers are provided near the slit glasses. Therefore, explanation of the same components is omitted.

In the image forming apparatus 1 according to this embodiment, the slit glass 33 is arranged in an opening 21*b* provided in the laser unit 21. Slopes 71 and 72 are formed around the opening 21*b*, respectively.

The slopes 71 and 72 are inclined such that both left and right sides in the figure from opening edges are located below center sides.

A first slope 71 is provided on one side of the slit glass 33. When a shutter is closed, the cleaning brush (the cleaning member 44) cleans the slit glass 33 after the tips (the distal end section 44*a*) of the cleaning brush (the cleaning member) 44 touch this slope.

A second slope 72 is provided on the other side of the slit glass 33. A deposit of dust and a toner scraped off from the slit glass 33 by the cleaning member 44 slips down on the slope 72.

Places where the deposit of dust and a toner scraped off from the slit glass 33 is stored (storing places 73 and 74) are provided at lower ends of the first slope 71 and the second slope 72. The places where the deposit of dust and a toner scraped off from the slit glass 33 is stored (the storing places 73 and 74) are set on outer sides of both the sides of the slit glass 33 in a shutter operating direction.

Adhesive layers 75 are provided on the surfaces of the storing places 73 and 74. The scraped-off deposit of dust and a toner adheres to the adhesive layers 75, whereby the deposit is prevented from adhering to the cleaning member 44 again.

The cleaning member 44 is cut into the slit glass 33 by about 0.5 mm to 3 mm. In other words, in a free state, the distal end section 44*a* of the cleaning member 44 is located below the upper surface 33*a* of the slit glass 33. A dimension E of a step between the upper surface 33*a* of the slit glass 33 and the distal end section 44*a* of the cleaning member 44 is set to 0.5 mm to 3 mm.

Figure 11:
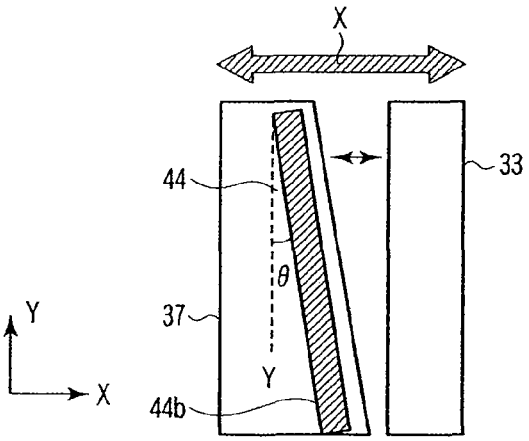
FIG. 11 is a plan view showing a configuration of the image forming apparatus according to the ninth embodiment.

Moreover, as shown in FIG. 11, the cleaning member 44 is inclined with respect to a direction orthogonal to the opening and closing direction in a plan view. The opening and closing direction of the shutter member 37 is along the X axis. An angle θ of inclination formed by a Y direction orthogonal to the X direction and a traveling direction edge 44*b* of the cleaning member 44 is set to, for example, 5 degrees or more.

In other words, in order to surely perform automatic cleaning, the slit glass 33 and the cleaning member 44 are brought into contact not to be flush with each other in parallel but to be inclined to each other.

According to this embodiment, effects described below are obtained. Since the slopes are provided, impact during cleaning is reduced. Since the dust and the toner scraped off from the slit glass 33 are collected in the storing places on both the sides, the dust and the toner is prevented from adhering to the slit glass 33 again.

Since the cleaning member 44 is cut into the slit glass 33 by about 0.5 mm to 3 mm, cleaning performance is improved.

Moreover, since a contact angle θ between the cleaning member 44 and the slit glass 33 is set to prevent the cleaning member 44 and the slit glass 44 from coming into contact to be flush with each other, cleaning performance is improved.

The present invention is not limited to the embodiment. For example, the one end side and the other end side are set on the right and the left, respectively. However, the present invention is not limited to this. The opening and closing direction and the irradiating direction of beams are not limited to those in the embodiments.

In the ninth embodiment, the storing places are set on both the sides of the slit glass 33 and the adhesive layers are provided on the surfaces of the storing places. However, the storing place and the adhesive layer may be provided only on one side.

In the embodiments, the photoconductive drums are used for the respective colors. However, a system for applying exposure for the four colors (Y, M, C, and B) to one photoconductive drum or a photoconductive belt may be adopted.

Besides, in the present invention, elements can be modified and embodied at an implementation stage without departing from the spirit of the present invention. Various inventions can be formed by appropriate combinations of the plural elements disclosed in the embodiments. For example, several elements may be deleted from all the elements disclosed in the embodiments. Moreover, the elements disclosed in the different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a beam irradiating unit that irradiates plural beams for color and black on photoconductive members;

a shutter in which plural blocking sections that block the plural beams, respectively, and plural transmitting sections that transmit the plural beams, respectively, are provided in parallel and that shift, in an opening and closing direction crossing an irradiating direction of the beams, among a first state in which the beams for black and color are opposed to the blocking sections, respectively, a second state in which the beam for color is opposed to the blocking section and the beam for black is opposed to the transmitting section, and a third state in which the beams for black and color are opposed to the transmitting sections and blocks or transmits the plural beams irradiated on the photoconductive members, respectively; and a single driving source which drives the shutter and is positioned on a side of the transmitting section for the beam for black.

2. The apparatus according to claim 1, wherein the shutter includes:

a first shutter corresponding to black;

a second shutter adjacent to the first shutter in the opening and closing direction;

a transferring section that transfers a motion of the first shutter to the second shutter; and a moving mechanism that shifts the first shutter among the first state, the second state, and the third state, the shutter is located from one side to the other side in the opening and closing direction in the order of the first state, the second state, and the third state, only the first shutter moves between the first state and the second state, and the second shutter moves in association with the motion of the first shutter transferred by the transferring section between the second state and the third state.

3. The apparatus according to claim 1, wherein the transmitting sections for black are provided on both one side and the other side in the opening and closing direction of the blocking section for black, and the shutter is located from one side to the other side in the opening and closing direction in the order of the second state, the first state, and the third state.

4. An image forming apparatus, comprising:

a shutter for black including black beam blocking sections configured to block a black laser beam and black beam transmitting sections configured to transmit the black laser beam;

a shutter for color including color beam blocking sections configured to block a color laser beam and color beam transmitting sections configured to transmit the color laser beam;

a controller configured to in a first state, position the black beam blocking sections in a path of the black laser beam and position the color beam blocking sections in a path of the color laser beam, in a second state, position the black beam transmitting sections in the path of the black laser beam and position the color beam blocking sections in the path of the color laser beam, and in a third state, position the black beam transmitting sections in the path of the black laser beam and position the color transmitting sections in the path of the color laser beam; and a single motor configured to move the shutter for black and the shutter for color based on instructions from the controller, the single motor positioned on a side closer to the shutter for black than the shutter for color.

5. The image forming apparatus according to claim 4, wherein the shutter for black and the shutter for color are configured integrally.

6. The image forming apparatus according to claim 5, further comprising:

a cam configured to receive moving force from the motor and contact the integrally configured shutters for black and color on the shutter for black side.

7. The image forming apparatus according to claim 6, further comprising:

a spring configured to move the integrally configured shutters for black and color to the shutter for color side.

8. The image forming apparatus according to claim 5, wherein the shutter for black is arranged in an order of the transmitting sections in the second state, the blocking sections in the first state, and the transmitting sections in the third state.

9. The image forming apparatus according to claim 4, wherein the shutter for black and the shutter for color are separately configured.

10. The image forming apparatus according to claim 9, further comprising:

a cam configured to receive driving force from the motor and contact the shutter for black at one end of the shutter for black.

11. The image forming apparatus according to claim 10, wherein the shutter for color includes a pusher and the other end of the shutter for black contacts the shutter for color.

12. The image forming apparatus according to claim 10, wherein the shutter for color further includes a spring configured to move the shutter for color on an end opposite to the side contacting the shutter for black.

13. The image forming apparatus according to claim 4, wherein the black beam transmitting sections in the second state and the third state are common.

14. The image forming apparatus according to claim 4, further comprising:

a slit glass in a housing of a laser unit; and a cleaner arranged to contact the slit glass and positioned on a side opposite to the slit glass of the shutter for black and/or the shutter for color.

15. The image forming apparatus according to claim 14, wherein the cleaner is formed by a foam.

16. The image forming apparatus according to claim 14, further comprising:

a counter configured to count a number of prints; and the controller configured to move the shutter for black and/or the shutter for color each time the counter counts a predetermined print number.

17. A control method of an image forming apparatus comprising a shutter for black including black beam blocking sections configured to block a black laser beam and black beam transmitting sections configured to transmit the black laser beam, a shutter for color including color beam blocking sections configured to block a color laser beam and color beam transmitting sections configured to transmit the color laser beam, and a single motor configured to move the shutter for black and the shutter for color based on instructions from a controller, the single motor positioned on a side closer to the shutter for black than the shutter for color, the method comprising:

positioning the black beam transmitting sections in the path of the black laser beam and positioning the color beam blocking sections in the path of the color laser beam, in a second state, and positioning the black beam transmitting sections in the path of the black laser beam and positioning the color transmitting sections in the path of the color laser beam, in a third state.

18. The method according to claim 17, wherein the shutter for black and the shutter for color are configured integrally.

19. The method according to claim 18, wherein the second state is for monochrome printing and the third state is for color printing.

* * * * *